US005284022A

United States Patent [19]

Chung

[11] Patent Number: 5,284,022

[45] Date of Patent: Feb. 8, 1994

[54] STIRLING CYCLE TYPE COLD AIR GENERATING DEVICE

[75] Inventor: Woo S. Chung, Seoul, Rep. of Korea

[73] Assignee: Goldstar Co. Ltd., Rep. of Korea

[21] Appl. No.: 958,948

[22] Filed: Oct. 9, 1992

[30] Foreign Application Priority Data

Oct. 10, 1991 [KR] Rep. of Korea ..... 17822/1991

[51] Int. Cl.[5] ..... F25B 9/00

[52] U.S. Cl. ..... 62/6; 62/434

[58] Field of Search ..... 62/6, 434

[56] References Cited

U.S. PATENT DOCUMENTS

| | | | |
|---|---|---|---|
| 4,843,826 | 7/1989 | Malaker | 62/6 |
| 4,872,313 | 10/1989 | Kazumoto et al. | 62/6 |
| 4,928,502 | 5/1990 | Kumada et al. | 62/6 |
| 5,142,872 | 9/1992 | Tipton | 62/6 |

*Primary Examiner*—Ronald C. Caposella

*Attorney, Agent, or Firm*—Ostrolenk, Fabr, Gerb & Soffen

[57] ABSTRACT

A Stirling cycle type cold air generating device comprising a Stirling module having a module cylinder and a module piston disposed in the module cylinder to be vertically reciprocated, a magnetic pole piston extending downwardly from a lower end of the module piston, the magnetic pole piston being moved integrally with the module piston, a pump cylinder disposed beneath a module cylinder of a module and isolated therefrom, and a pump piston disposed in the pump cylinder to be vertically reciprocated, the pump piston defining an upper pumping chamber for pumping the heat transfer medium and a lower pumping chamber for pumping the brine in the interior of the pump cylinder. The magnetic pole piston and the pump piston are magnetically connected by means of a magnetic coupling disposed around both the module cylinder and the pump cylinder to move vertically therealong. The magnetic coupling has an upper end serving as an electromagnet for applying a magnetic attraction to the magnetic pole piston and a lower end serving as an electromagnet for applying a magnetic attraction to the pump piston.

8 Claims, 4 Drawing Sheets

STIRLING CYCLE TYPE COLD AIR GENERATING DEVICE

BACKGROUND OF THE INVENTION

1. Field of the Invention

The present invention relates to a cold air generating device, and more particularly to a cold air generating device of Stirling cycle type in which a brine for transferring cold air and a heat-discharging heat transfer medium are circulated to achieve a heat transfer therebetween.

2. Description of the Prior Art

Referring to FIGS. 1 and 2, there is illustrated a refrigerator equipped with a conventional Stirling cycle type cold air generating device. As shown in FIGS. 1 and 2, the refrigerator comprises a Stirling module (a freezer) 1 for generating a cooling effect according to the Stirling cycle, a heat-absorbing heat exchanger 3 for heat-exchanging cold air generated from a heat absorber (a cold air generating unit) 2 with air in a refrigerator, a brine serving as an operating medium for feeding cold air to the heat-absorbing heat exchanger 3 and having a characteristic of not freezing at a low temperature, and a heat-absorbing-side circulation pump 4 for circulating the brain. The refrigerator also comprises a heat-discharging heat exchanger 6 for discharging heat radiated from a radiator 5 of the Stirling module 1 at air in a room at which the refrigerator is installed, a liquid, for example, water, serving as an operating medium for transferring heat from the radiator 5 to the heat-discharging heat exchanger 6 and having a high specific heat and a high convection heat transfer coefficient, and a heat-discharging-side circulation pump 7 for circulating the liquid. In addition, the refrigerator comprises a cold air circulating unit 8 for feeding air cooled upon passing the heat-absorbing heat exchanger 3 to required parts of the refrigerator, and a temperature sensor 9.

In FIGS. 1 and 2, the reference numeral 13 denotes a linear motor, 14 a piston, 15 a displacer, 16 a regenerator, 17 a compression chamber, 18 a reaction space, 19 a voltage controller, 20 a microcomputer, 21 a voltage controller and 22 a cylinder.

In such a conventional Stirling cycle type refrigerator, a cooling effect is generated at the heat absorber 2 of module 1 and an expansion chamber 10, by the module 1 operating in the Stirling cycle. The generated cooling effect is transferred to the brine filled in a shell 11 of the heat absorber 2. The cooled brine is fed to the heat-absorbing heat exchanger 3 by the heat-absorbing-side circulation pump 4, so that it exchanges heat with air in the refrigerator to generate freezing and refrigerating effects of the refrigerator and circulates continuously. The heat radiated from the radiator 5 of the Stirling module 1 is transferred to the liquid having high specific heat and heat transfer coefficient and filled in a shell 12 of the radiator 5. The heated liquid is then fed to the heat-discharging heat exchanger 6 by the heat-discharging-side circulation pump 7 so that it discharges heat at air in the room at which the refrigerator is installed. By such a heat discharge, the liquid is cooled by itself. The liquid returns to the radiator shell 12 and then circulates continuously.

The above-mentioned conventional cold air generating device includes two pumps one being the heat-absorbing-side circulation pump 4 for circulating the cooling effect generated at the Stirling module 1 to the heat-absorbing heat exchanger 3 by means of the brain and the other being the heat-discharging-side circulation pump 7 for transferring the heat radiated from the radiator 5 of module 1 to the heat-discharging heat exchanger 6. This construction results in a complexity of the overall construction of freezing system and an increase in cost. For obtaining sufficiently an advantageous capacity control being a characteristic of the Stirling freeze, respective capacities of the heat-absorbing-side circulation pump 4 and the heat-discharging-side circulation pump 7 should be varied to correspond to the variation in capacity of the module 1. As a result, a pump with variable capacity is required. There is also required an accessary device for sensing the variation in capacity of the module 1 and controlling the pump according to the sensed variation. These devices make the refrigerator increase in cost.

SUMMARY OF THE INVENTION

Therefore, an object of the present invention is to eliminate the above-mentioned disadvantages encountered in the prior art and to provide a Stirling cycle type cold air generating device wherein a brine circulating pump for feeding cold air and a heat transfer medium circulating pump for discharging heat which are disposed at the cylinder lower portion of a Stirling module are integral with each other.

Another object of the invention is to provide a Stirling cycle type cold air generating device having a pump cylinder disposed beneath a module cylinder of a module and isolated therefrom and a pump piston disposed in the pump cylinder and connected operatively magnetically with a module piston by means of a magnetic coupling, thereby capable of eliminating a requirement of additional sealing means for preventing an operating medium of the module and a heat transfer medium from being mixed with each other.

In accordance with the present invention, these objects can be accomplished by providing a Stirling cycle type cold air generating device comprising: a Stirling module having a module cylinder and a module piston disposed in the module cylinder to be vertically reciprocated; a heat-absorbing heat exchanger being communicated with the Stirling module; a brine serving as an operating medium for transferring cold air to the heat-absorbing heat exchanger; a heat-discharging heat exchanger being communicated with the Stirling module; a heat transfer medium for transferring heat to the heat-discharging heat exchanger; a pump cylinder disposed beneath the module cylinder and isolated therefrom; a pump piston disposed in the pump cylinder to be vertically reciprocated, the pump piston defining an upper pumping chamber for pumping the heat transfer medium and a lower pumping chamber for pumping the brine in the interior of the pump cylinder; a magnetic pole piston extending downwardly from a lower end of the module piston, the magnetic pole piston being moved integrally with the module piston; connecting means adapted to connect operatively magnetically the pump piston and the magnetic pole piston with each other; first communicating means adapted to communicate selectively the upper pumping chamber with the Stirling module and the heat-absorbing heat exchanger; and second communicating means adapted to communicate selectively the lower pumping chamber with the Stirling module and the heat-discharging heat exchanger.

BRIEF DESCRIPTION OF THE DRAWINGS

Other objects and aspects of the invention will become apparent from the following description of embodiments with reference to the accompanying drawings in which.

DESCRIPTION OF THE PREFERRED EMBODIMENTS

Figure 1:
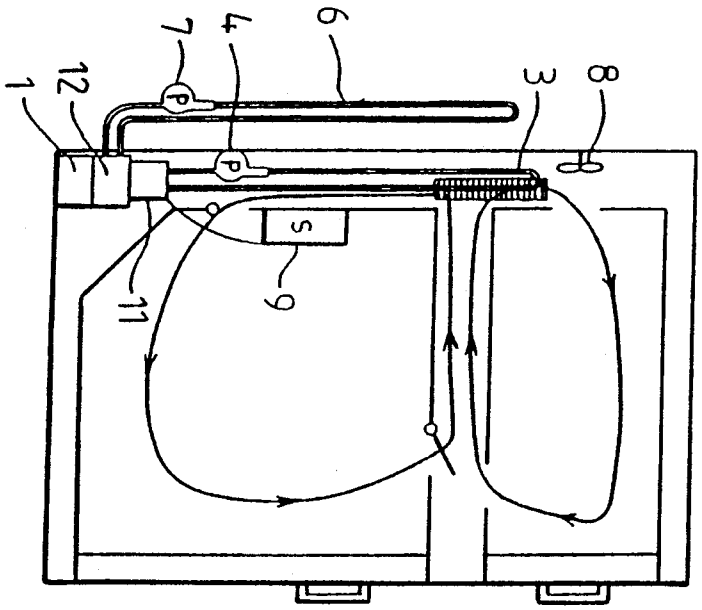
FIG. 1 PRIOR ART
FIG. 1 is a sectional view of a conventional Stirling cycle type refrigerator.
Figure 2:
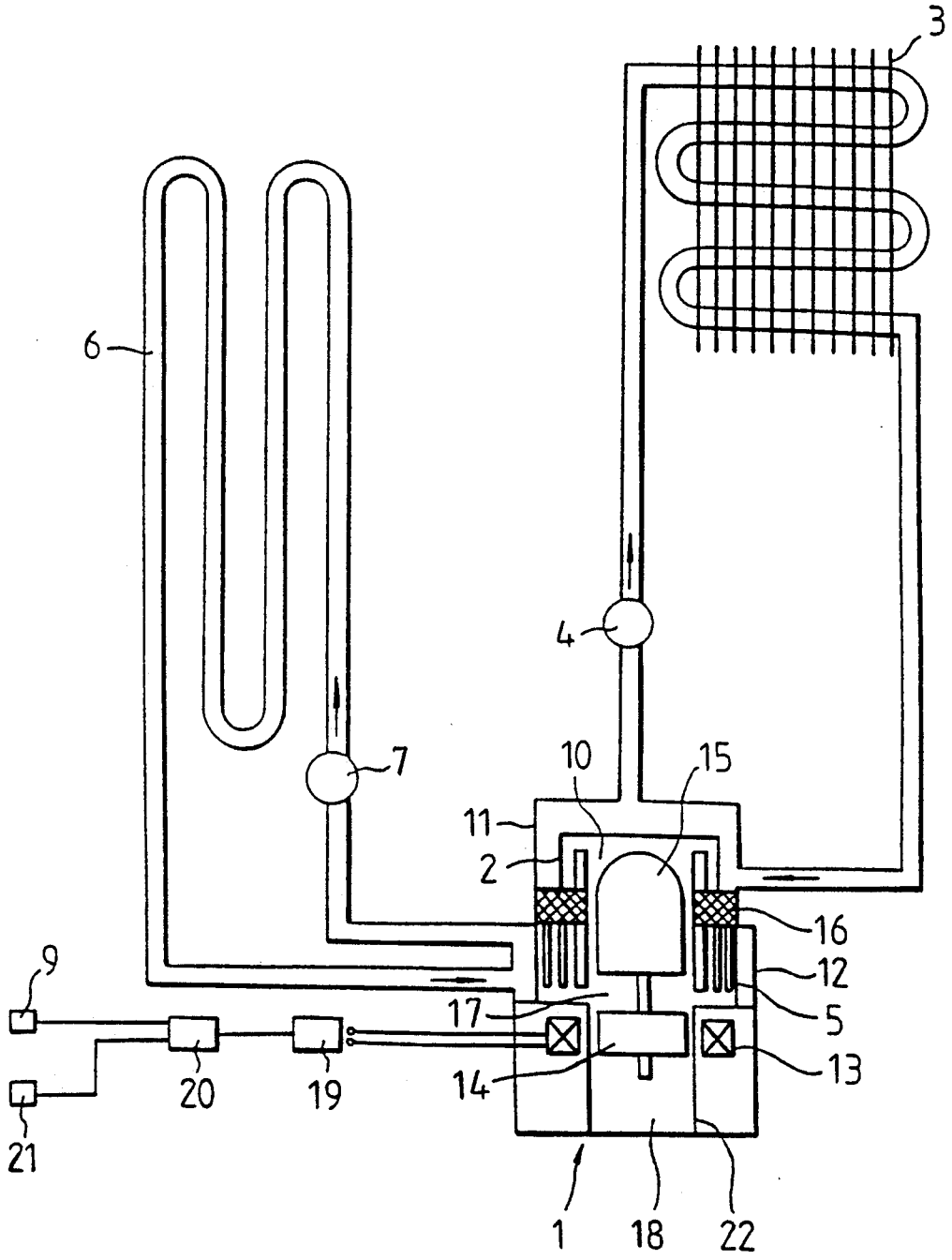
FIG. 2 PRIOR ART
FIG. 2 is a sectional view of a cold air generating device equipped in the device of FIG. 1.
Figure 3:
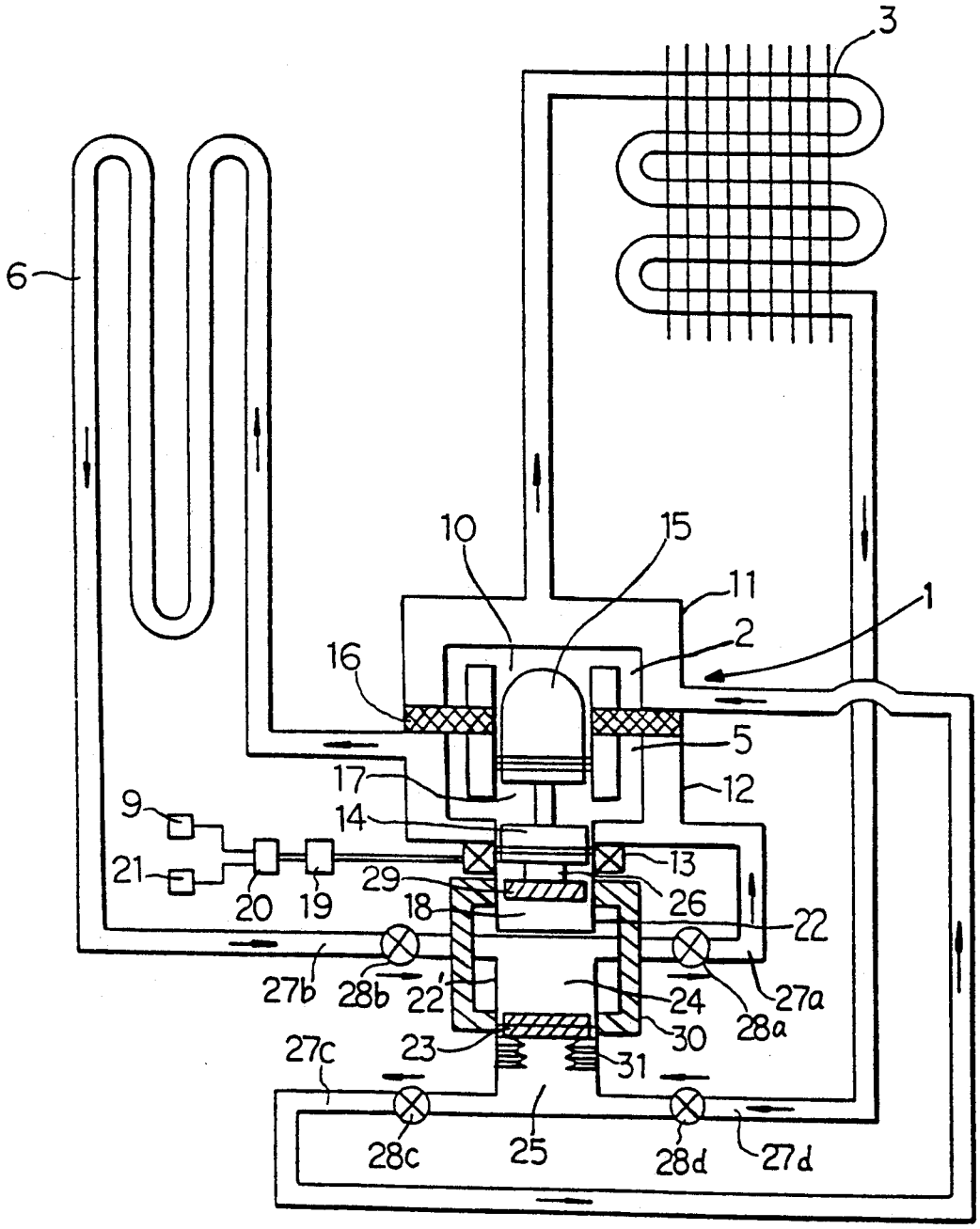
FIG. 3 is a sectional view of a Stirling cycle type cold air generating device in accordance with the present invention.

FIG. 3 is a sectional view of a Stirling cycle type cold air generating device in accordance with the present invention. As shown in FIG. 3, the cold air generating device has constructions identical to those of the conventional cold air generating device shown in FIGS. 1 and 2. In FIG. 3, therefore, the identical elements are denoted by the same reference numerals as those in FIGS. 1 and 2 and their detailed description is omitted.

The device comprises a Stirling module 1, a heat-absorbing heat exchanger 3, a heat-discharging heat exchanger 6. The Stirling module 1 has a cylinder 22 and a module piston 14 disposed to be vertically reciprocated in the cylinder 22. Beneath the Stirling module 1 is disposed a linear motor 13 which functions to move the module piston 14.

In accordance with the present invention, the Stirling module 1 has a pump cylinder 22' disposed beneath the cylinder 22 and isolated therefrom. Within pump cylinder 22' is disposed a pump piston 23 which defines a upper pumping chamber 24 for pumping a heat transfer medium and a lower pumping chamber 25 for pumping a brine in the interior of pump cylinder 22'.

For reciprocating vertically the pump piston 23 in the interior of pump cylinder 22' upon vertical reciprocating movements of the module piston 14, a magnetic pole piston 29 having a strong magnetic force is attached to the lower end of module piston 14, by means of a connecting rod 26 extending from the lower end of module piston 14.

In accordance with the present invention, a magnetic coupling 30 is disposed to surround partially the cylinders 22 and 22' and move along the outer wall surfaces of cylinders 22 and 22'. The magnetic coupling 30 has an upper end 30*a* disposed around the cylinder 22 and a lower end 30*b* disposed around the pump cylinder 22'. The magnetic coupling 30 serves to connect the magnetic pole piston 29 and the pump piston 23 with each other. This connection is not a mechanical direct connection, but a non-contact connection achieved by a magnetic force generated at the magnetic coupling 30, as will be described hereinafter. The pump piston 23 is also made of a magnetic material, so as to receive a power from the magnetic coupling 30.

For pumping the brine and the heat transfer medium selectively upon the reciprocating movements of the pump piston 14, the upper pumping chamber 24 have two passages 27*a* and 27*b* and the lower pumping chamber 25 have two passages 27*c* and 27*d*. In the passages 27*a* to 27*d*, one-directional check valves 28*a* to 28*d* are disposed, respectively.

Within the lower pumping chamber 25, a bellows seal 31 is disposed which functions to prevent the brine and the heat transfer medium form being mixed with each other due to their leakage occurring during the reciprocating movements of the pump piston 23. The bellows seal 31 has an upper surface being in contact with the lower surface of the pump piston 23 and an outer surface being in contact with the inner wall surface of the lower pumping chamber 25. Alternatively, the bellows seal 31 may be disposed in the upper pumping chamber 24. In this case, the bellows seal 31 has an lower surface being in contact with the upper surface of the pump piston 23 and an outer surface being in contact with the inner wall surface of the upper pumping chamber 24.

The passage 27*a* serves to communicate the upper pumping chamber 24 with the radiator shell 12. The check valve 28*a* disposed in the passage 27*a* allows the heat transfer medium to flow from the upper pumping chamber 24 only to the radiator shell 12.

The passage 27*b* serves to communicate the upper pumping chamber 24 with the outlet of the heat-discharging heat exchanger 6. The check valve 28*b* disposed in the passage 27*b* allows the heat transfer medium to flow from the heat-discharging heat exchanger 6 only to the upper pumping chamber 24.

The passage 27*c* serves to communicate the lower pumping chamber 25 with the heat absorber shell 11. The check valve 28*c* disposed in the passage 27*c* allows the cold air-transferring brine to flow from the upper pumping chamber 24 only to the heat absorber shell 11.

The passage 27*d* serves to communicate the lower pumping chamber 25 with the outlet of the heat-absorbing heat exchanger 3. The check valve 28*d* allows the brine to flow from the heat-absorbing heat exchanger 3 only to the lower pumping chamber 25.

Since the pump piston 23 is interposed between the hot heat transfer medium in the upper pumping chamber 24 and the cold brine in the lower pumping chamber 25, it is made of an thermal insulation material for reducing a thermal loss caused by heat transfer.

Although the upper pumping chamber 24 and the lower pumping chamber 25 have been described as being adapted to pump the heat-transfer medium and the brine, respectively, they may be constructed to pump the brine and the heat transfer medium, respectively.

Figure 4:
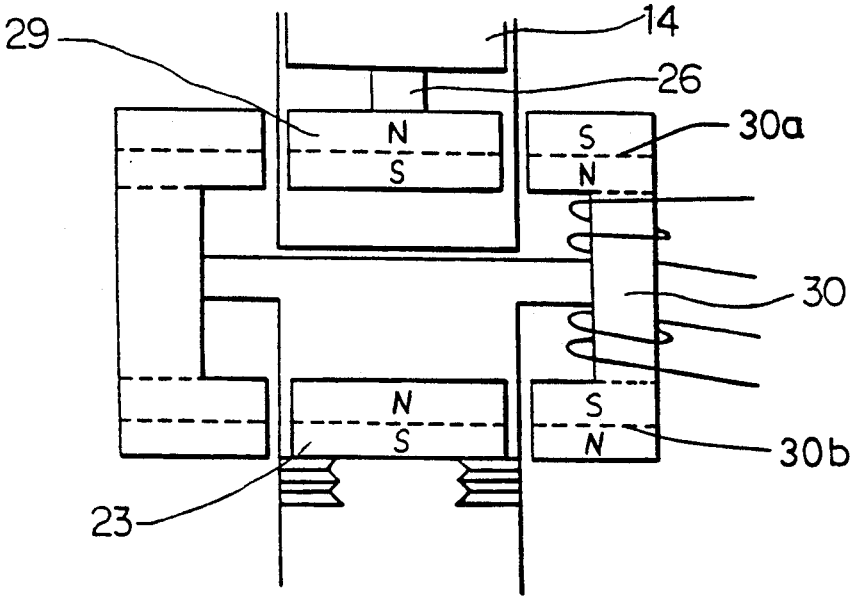
FIG. 4 is a schematic view of a magnetic connection in accordance with the present invention.

The magnetic pole piston 29 made of a material having a strong magnetic property, that is, a permanent magnet, comprises an upper portion as N pole and a lower portion as P pole, as shown in FIG. 4. In similar, the pump piston 23 made of a material having a strong magnetic property, that is, a permanent magnet, also comprises an upper portion as N pole and a lower portion as P pole. In this case, the upper end 30*a* of the magnetic coupling 30 comprises an upper S pole portion and a lower N pole portion which surround the upper N pole portion and the lower S pole portion of the magnetic pole piston 29, respectively. On the other hand, the lower end 30*b* of the magnetic coupling 30 comprises an upper S pole portion and a lower N pole portion which surround the upper N pole portion and the lower S pole portion of the pump piston 23, respectively. With this construction having opposite magnetic arrangements, magnetic attractions are generated between the upper end 30*a* of magnetic coupling 30 and the magnetic pole piston and between the lower end 30*b* of magnetic coupling 30 and the pump piston 23. By virtue of these magnetic attractions, the pistons 29 and 23 are connected in a non-contract manner by means of the magnetic coupling 30, so that they can be moved integrally, together with the magnetic coupling 30.

Of course, each of the pistons 29 and 23 may have a reversed magnetic arrangement such that its upper portion and lower portion exhibit S pole and N pole, respectively. In this case, the magnetic coupling 30 should have a reversed magnetic arrangement, so as to keep the opposite magnetic arrangements to the pistons 29 and 23.

As apparent from the above description, the magnetic coupling 30 has a pair of electromagnets corresponding to the magnetic pole piston 29 and the pump piston 23, respectively.

Operation of the device according to the present invention will now be described in conjunction with FIG. 3.

As the piston 14 is vertically reciprocated by the linear motor 13, the magnetic pole piston 29 connected to the piston 14 by means of the connecting rod 26 is vertically reciprocated. By the magnetic force of the reciprocating movement of magnetic pole piston 29, the magnetic coupling 30 disposed around the cylinders 22 and 22' is vertically reciprocated along the cylinders 22 and 22'. In similar, the pump piston 23 which is magnetically connected with the magnetic coupling 30 is vertically reciprocated between the upper pumping chamber 24 and the lower pumping chamber 25.

When the pump piston 23 moves downwardly, that is, from the upper pumping chamber 24 toward the lower pumping chamber 25, the cold air-transferring brine filled in the lower pumping chamber 25 opens the check valve 28*c* and is then fed to the heat absorber shell 11, via the passage 27*c*. In the heat absorber shell 11, the brine is cooled and then fed to the heat exchanger 3 so that it generates a cooling effect. Upon the downward movement of pump piston 23, a vacuum and thus a suction force are generated in the upper pumping chamber 24. By this suction force, the check valve 28*b* is opened and the heat-discharging heat transfer medium from the heat-discharging heat exchanger 6 is sucked in the upper pumping chamber 24, via the passage 27*b*.

On the other hand, when the pump piston 23 moves upwardly, that is, from the lower pumping chamber 25 toward the upper pumping chamber 24, the heat transfer medium sucked in the upper pumping chamber 24 opens the check valve 28*a* and is then fed to the radiator shell 12, via the passage 27*a*. In the radiator shell 12, the heat transfer medium is heated and then fed to the heat exchanger 6 so that it discharges heat therefrom. Upon the upward movement of pump piston 24, a vacuum and thus a suction force are generated in the lower pumping chamber 25. By this suction force, the check valve 28*d* is opened and the cold air-transferring brine from the heat exchanger 3 is sucked in the lower pumping chamber 25, via the passage 27*d*.

As mentioned above, the reciprocating movements of piston 14 for generating a cooling effect causes the reciprocating movements of pump piston 23 which is magnetically connected to the piston 14 by means of the magnetic coupling 30, so that the intake and discharge operations are repeated, thereby enabling continued circulations of the brine and the heat transfer medium. Thus, the function of refrigerator is achieved.

As apparent from the above description, the present invention provides a cold air generating device having no requirement of a heat-absorbing-side circulation pump and a heat-discharging-side circulation pump which have been needed in the conventional device. As a result, it is possible to reduce the cost and simplify the overall construction. In accordance with the present invention, the pump piston is connected with the module piston in a non-contact manner, by means of the magnetic coupling, thereby eliminating the requirement of additional sealing means for preventing the operating medium of module and the heat transfer medium from being mixed with each other. Upon an increase in speed of the module piston, the speed of pump piston is correspondingly increased. By such a construction, two pumps with variable capacity which can respond immediately to the variation in capacity of the module are provided without requiring any additional control means, thereby enabling an improvement in efficiency.

Although the Stirling cycle type cold air generating device of the present invention has been applied to refrigerators, it can be equivalently applied to air conditioners. In this case, the heat-absorbing heat exchanger is equipped in an indoor unit, while the heat-discharging heat exchanger 6 is equipped in an outdoor unit.

Although the preferred embodiments of the invention have been disclosed for illustrative purpose, those skilled in the art will appreciate that various modifications, additions and substitutions are possible, without departing from the scope and spirit of the invention as disclosed in the accompanying claims.

What is claimed is:

1. A Stirling cycle type cold air generating device comprising:

a Stirling module having a module cylinder and a module piston disposed in the module cylinder to be vertically reciprocated;

a heat-absorbing heat exchanger being communicated with the Stirling module;

a brine serving as an operating medium for transferring cold air to the heat-absorbing heat exchanger;

a heat-discharging heat exchanger being communicated with the Stirling module;

a heat transfer medium for transferring heat to the heat-discharging heat exchanger;

a pump cylinder disposed beneath the module cylinder and isolated therefrom;

a pump piston disposed in the pump cylinder to be vertically reciprocated, the pump piston defining an upper pumping chamber for pumping the heat transfer medium and a lower pumping chamber for pumping the brine in the interior of the pump cylinder;

a magnetic pole piston extending downwardly from a lower end of the module piston, the magnetic pole piston being moved integrally with the module piston;

connecting means adapted to connect operatively magnetically the pump piston and the magnetic pole piston with each other;

first communicating means adapted to communicate selectively the upper pumping chamber with the Stirling module and the heat-absorbing heat exchanger; and second communicating means adapted to communicate selectively the lower pumping chamber with the Stirling module and the heat-discharging heat exchanger.

2. A Stirling cycle type cold air generating device in accordance with claim 1, wherein both the pump piston and the magnetic pole piston are made of magnets having a strong magnetic property, respectively.

3. A Stirling cycle type cold air generating device in accordance with claim 2, wherein the connecting means comprises a magnetic coupling disposed around both the module cylinder and the pump cylinder to move vertically therealong, the magnetic coupling having an upper end serving as an electromagnet for applying a magnetic attraction to the magnetic pole piston and a lower end serving as an electromagnet for applying a magnetic attraction to the pump piston.

4. A Stirling cycle type cold air generating device in accordance with claim 1, wherein the first communicating means comprises:

a first passage adapted to communicate the upper pumping chamber with the module;

a first check valve disposed in the first passage and adapted to allow the heat transfer medium to flow from the upper pumping chamber to the module;

a second passage adapted to communicate the upper pumping chamber with the heat-discharging heat exchanger; and a second check valve disposed in the second passage and adapted to allow the heat transfer medium to flow from the heat-discharging heat exchanger to the upper pumping chamber.

5. A Stirling cycle type cold air generating device in accordance with claim 1, wherein the second communicating means comprises:

a first passage adapted to communicate the lower pumping chamber with the module;

a first check valve disposed in the first passage and adapted to allow the brine to flow from the lower pumping chamber to the module;

a second passage adapted to communicate the lower pumping chamber with the heat-absorbing heat exchanger; and a second check valve disposed in the second passage and adapted to allow the brine to flow from the heat-absorbing heat exchanger to the lower pumping chamber.

6. A Stirling cycle type cold air generating device in accordance with claim 1, further comprising:

means adapted to prevent the heat transfer medium in the upper pumping chamber and the brine in the lower pumping chamber from being mixed with each other.

7. A Stirling cycle type cold air generating device in accordance with claim 6, wherein the means comprises a bellows seal disposed in the lower pumping chamber and provided with an upper surface being in contact with a lower surface of the pump piston and an outer surface being in contact with an inner wall surface of the lower pumping chamber.

8. A Stirling cycle type cold air generating device in accordance with claim 6, wherein the means comprises a bellows seal disposed in the upper pumping chamber and provided with an lower surface being in contact with an upper surface of the pump piston and an outer surface being in contact with an inner wall surface of the upper pumping chamber.

* * * * *